US005405100A

United States Patent [19]

Cooper et al.

[11] Patent Number: 5,405,100

[45] Date of Patent: Apr. 11, 1995

[54] BELT LET-OFF ASSEMBLY

[75] Inventors: John S. Cooper, Fountain Inn; Walker O. Graham, Waterloo, both of S.C.

[73] Assignee: Cooper Machinery, Inc., Fountain Inn, S.C.

[21] Appl. No.: 894,243

[22] Filed: Jun. 8, 1992

Related U.S. Application Data

[63] Continuation of Ser. No. 578,644, Sep. 6, 1990, abandoned.

[51] Int. Cl.[6] ..... B65H 16/02

[52] U.S. Cl. ..... 242/564.5; 242/541.3

[58] Field of Search ..... 242/58.1, 58.2, 58.6, 242/68.7, 78.7, 58, 533, 539, 541.3, 564.5, 393, 420.2, 352.4, 550

[56] References Cited

U.S. PATENT DOCUMENTS

| | | | |
|---|---|---|---|
| 2,343,899 | 3/1944 | Groll et al. | 242/78.7 |
| 2,441,544 | 5/1948 | Longfield | 242/78.7 |
| 2,977,058 | 3/1961 | Hornstein et al. | 242/78.7 |
| 3,332,827 | 7/1967 | Griffith et al. | 242/76 |
| 3,782,649 | 1/1974 | Frederick et al. | 242/68.7 X |
| 4,575,016 | 3/1986 | Pali | 242/58.6 |
| 4,638,957 | 1/1987 | Graves | 242/58.6 |
| 4,728,089 | 3/1988 | Barrett | 242/58.6 |
| 4,744,526 | 5/1988 | Kremar | 242/58.6 |

FOREIGN PATENT DOCUMENTS 2437364 4/1980 France .

OTHER PUBLICATIONS

G. E. Price, Belt Drive Roll Stock Feed, Sep. 1973, IBM Technical Disclosure Bulletin, vol. 16, No. 4.

*Primary Examiner*—Daniel P. Stodola
*Assistant Examiner*—John Q. Nguyen
*Attorney, Agent, or Firm*—Dority & Manning

[57] ABSTRACT

Apparatus for unwinding rolls of material such as fabric and the like including a frame and a generally V-shaped cradle pivotally attached to the frame for supporting the material to be unwound. The cradle includes first and second belt support structures for supporting multiple driven endless belts. The endless belts form the driving and support surface for the material roll to be unwound. The apparatus is pivotal between a loading portion and an unwind position.

27 Claims, 3 Drawing Sheets

BELT LET-OFF ASSEMBLY

This is a continuation of application Ser. No. 07/578,644, filed Sep. 6, 1990, now abandoned.

BACKGROUND OF THE INVENTION

The present invention relates generally to a belt let-off or unwind device for unwinding fabrics or material from a roll. Material rolls can be extremely heavy, weighing over 2000 pounds, and it is necessary to unwind the fabric from these rolls for further use of the fabric. The rolls of material are often not uniform and a problem exists in unwinding the rolls to a take-up unit without causing wrinkles, puckers or creases, and providing the material to the take-up roll in as good a condition as possible. Problems are caused when the material roll is not driven smoothly in addition to when the rolls bounce in the unwind apparatus during unwinding. It is also important to maintain lateral alignment of the rolls without interfering with the operation of the unwinding device. In addition, because of the size and weight of the material rolls, it is difficult to load and unload the rolls from the let-off unit.

It is known in the prior art to provide a device for unwinding various types of rolls. For example, U.S. Pat. No. 4,757,951, issued to Ludszeweit, discloses one such device. The apparatus disclosed in Ludszeweit is for changing bobbins of wrapping material in a cigarette making machine. Ludszeweit provides for the continuous feeding of rolls into the unwinding portion of a machine and for unwinding the rolls thereat. Other unwinding devices for various materials are disclosed in U.S. Pat. No. 2,977,058, U.S. Pat. No. 4,093,139, U.S. Pat. No. 3,643,885 and U.S. Pat. No. 2,345,656.

Thus, various means for unwinding rolls are known. However, functional shortcomings of the prior art devices that this invention attempts to solve are numerous. Heavy rolls of material are difficult to load and it is difficult to drive them smoothly and continuously to provide the good unwind characteristics, particularly as the roll unwinds and becomes smaller in diameter. In addition, irregularly shaped rolls are particularly inclined to become misaligned in an unwind device.

SUMMARY OF THE INVENTION

The present invention recognizes and addresses the foregoing disadvantages, and others, of the prior art unwinding devices. Accordingly, it is an object of the present invention to provide an improved unwinding or let-off device for unwinding material from a roll.

It is another object of the present invention to provide an improved let-off device in which the material is unwound without creases, puckers, or wrinkles and with good tension control.

It is a further object of the present invention to provide a let-off device that will allow the material to be easily loaded and unloaded.

These and other objects of the present invention are achieved by providing an apparatus for unwinding heavy rolls of material such as fabric and the like comprising a frame and a generally V-shaped cradle pivotally attached to the frame for supporting the material to be unwound. The generally V-shaped cradle includes first and second belt support means. Each of the belt support means forms one side of the V-shaped cradle. The V-shaped cradle is pivotal between a loading position where one of the belt support means of the cradle is substantially horizontal and an unwind position where both belt support means of the cradle are angularly spaced above the horizontal. The apparatus further comprises means for controllably pivoting the V-shaped cradle relative to the frame for loading and unloading the material to be wound. The first and second belt support means each include a plurality of endless belts. The plurality of endless belts form the support and driving surface for the material to be unwound, and are supported on the belt support means such that the weight of the roll displaces the belts in contact with the roll and provides an increased area of driving contact between the roll and the belts.

The belt support means include means for maintaining the endless belts in alignment, and the apparatus further includes means for driving the endless belts, wherein a web of material can be received within the V-shaped cradle and can be positively unwound from a roll.

Preferably, these and other objects are also achieved by the endless belts on both the first and second support means being driven in the same direction causing the surfaces of the belts in contact with the material roll on the first support means to move in one direction and the surfaces of the belts in contact with the material roll on the second support means to move in the opposite direction. In addition, the apparatus includes a base supporting the frame, the frame being laterally movable on the base so the material being unwound can be aligned with the device receiving the material. It is also preferable that the belt support means includes a plurality of spaced apart rolls for receipt of the endless belts thereon.

Further, some objects of the present invention are achieved when the means for maintaining the endless belts in alignment includes raised central ridges on at least one of the spaced apart rolls adapted for receipt of the endless belts thereover so that the belts will remain aligned on the rolls.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
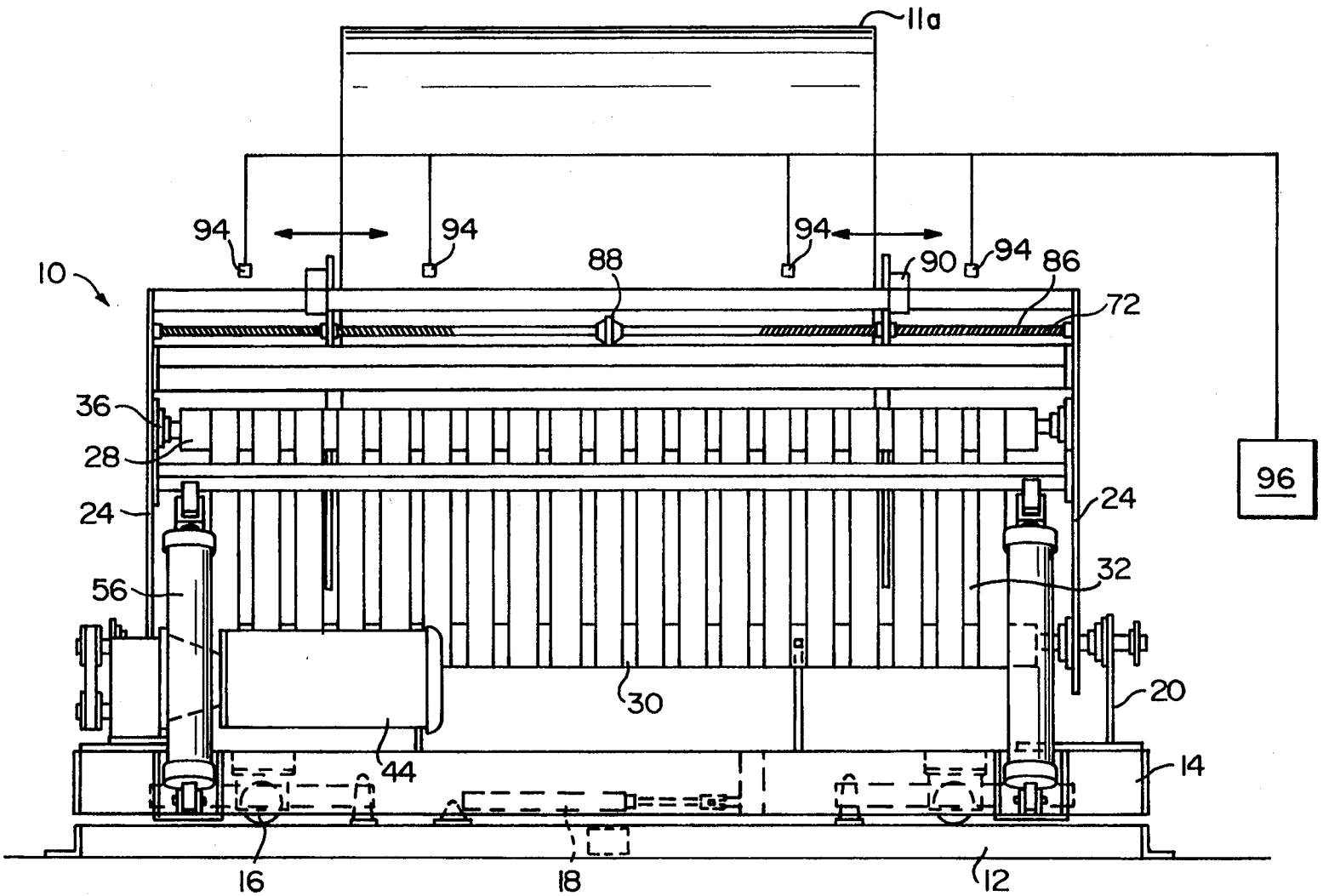
FIG. 1 is front view of an unwind machine in accordance with the present invention.

Repeat use of reference characters in the present specification and drawings is intended to represent same or analogous features or elements of the invention.

DETAILED DESCRIPTION OF PREFERRED EMBODIMENTS

Figure 2:
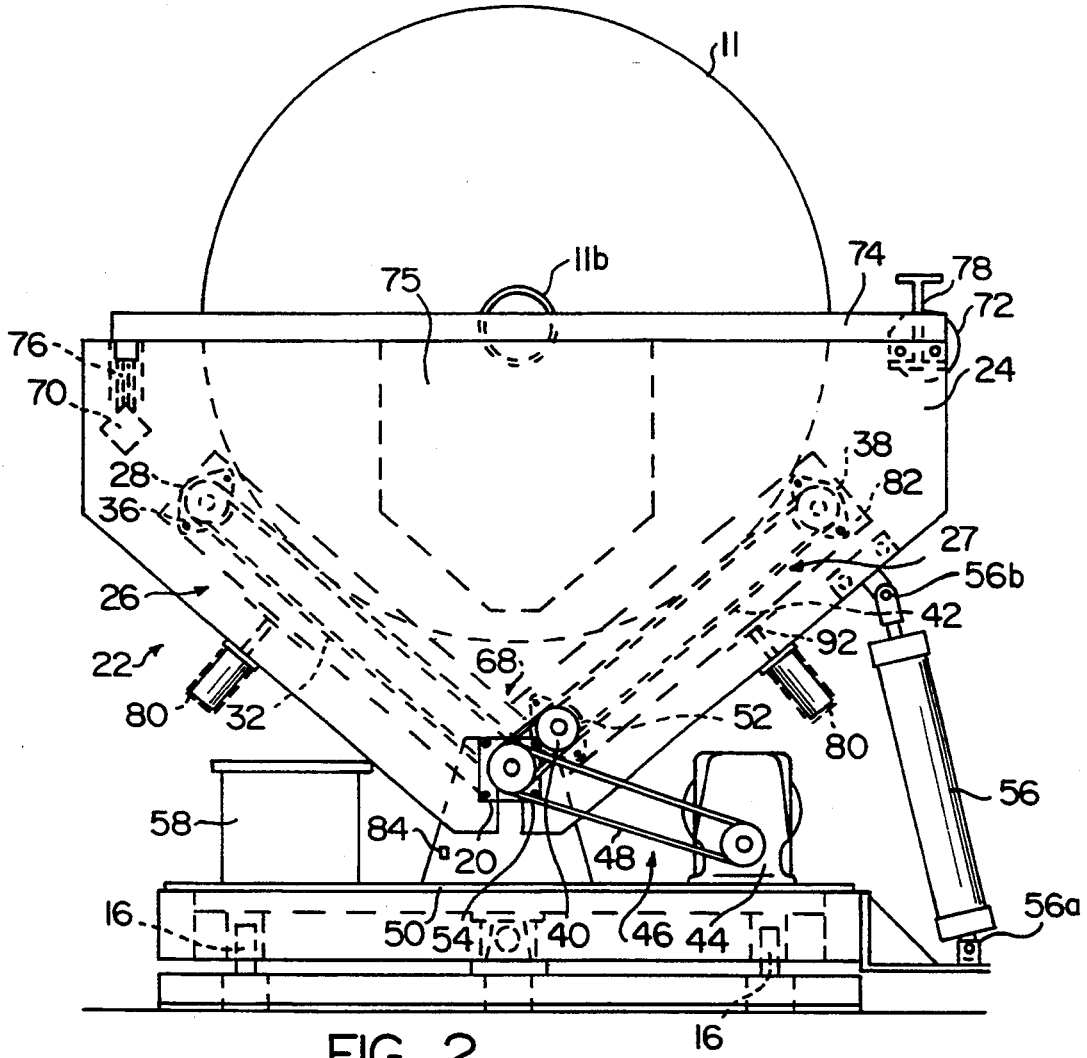
FIG. 2 is a side view of FIG. 1 with the unwind machine in its unwind position.

It is to be understood by those of ordinary skill in the art that the present discussion is a description of exemplary embodiments only, and is not intended as limiting the broader aspects of the present invention, which broader aspects are embodied in the exemplary constructions. Referring to FIGS. 1 and 2, a belt let-off or unwind machine generally 10 adapted to unwind a heavy roll of material or fabric 11 to a take-up device or the like 11*a* in accordance with the present invention is disclosed. The unwind machine includes a base 12 and a frame 14 movably attached to the base 12. The frame includes rollers 16 adapted to roll on frame 14 to allow the base and frame to move laterally with respect to each other. The base includes at least one pressure actuated cylinder 18 for controllably moving the frame with respect to the base.

As illustrated in FIGS. 1 and 2, the frame 14 includes a cradle support member 20 attached thereto to support a material roll receiving cradle generally illustrated as 22. Cradle 22 is generally V-shaped as best illustrated in FIG. 2 and includes end panels 24 on opposite lateral ends. The cradle is pivotally attached to frame 14 through the cradle support member 20.

In accordance with the invention, cradle 22 includes first and second belt support means 26, 27, each forming one side of the V-shaped cradle. As embodied herein, the first and second belt support means includes a plurality of spaced apart rolls or shafts 28, 30, 38 and 40. The rolls or shafts 28, 30 of the first belt support means are arranged in spaced apart relation and attached at their ends on end panels 24. The rolls or shafts 28, 30 are longitudinally extending and are attached to end panels 24 through bearing arrangements 36.

Second belt support means 27 includes rolls supported in spaced apart relation and attached at their ends to end panels 24. Rolls 38, 40 are like those of the first belt support means and comprise longitudinally extending rolls or shafts as illustrated. The rolls 38, 40 are attached to end panels 24 through bearing arrangements 36.

Endless belts 32 and 42 form the support and driving surface for the material to be unwound. Preferably, a plurality of relatively narrow endless belts 32 and 42 received around the respective rolls 28, 30, 38, 40 both support and drive the material roll and assist in maintaining the material roll in lateral alignment. In addition, belts 32, 42 allow for smooth driving and supporting contact even if the material roll is out-of-round, such as egg-shaped.

As best indicated in FIG. 2, rolls 28, 30 and 38, 40 are spaced apart, and there is no other support for the endless belts therebetween in the unwind position. Since the endless belts form the support and driving surface for the material to be unwound, the material roll will deform the endless belts in the areas of contact providing increased surface contact between the belts and the material roll, producing a more effective driving contact. The endless belts 32 on the first belt support means 26 are driven in the same direction as the endless belts 42 on the second belt support means 27. As a result, the portions of the belts on the first belt support means that are in contact with the material roll move in an opposite direction to the contact portions of the belts on the second support means. Therefore, one set of belts tends to drive the material roll 11 into the bottom and center 68 of the V-shaped cradle as illustrated in FIG. 2, thereby minimizing the tendency of the material roll to ride out of, or bounce in the cradle when being unwound. This is facilitated in the present invention by the use of a plurality of endless belts on the first and second support means, rather than continuous belts forming a V shape.

Use of separate sets of belts minimizes any upward component of belts driving the roll into the bottom and center 68 of the cradle and, therefore, minimizes bounce and the tendency of the roll to ride out of the cradle. In addition, the V-shaped cradle oriented in the unwind position as in the present invention provides smooth and continuous unwinding and enhanced tension control throughout diameter changes of the roll as it unwinds, because gravity draws the roll down as it unwinds and becomes smaller.

The apparatus of the present invention further includes means for driving the endless belts. As embodied herein, the means for driving the endless belts includes a reversible motor 44 attached either directly or via a belt or chain configuration 46 to the lower rolls 30 and 40 of the belt support means 26 and 27. It should be understood by one of ordinary skill in the art that the lower rolls of the first and second support means 26 and 27 may be a single roll or shaft, or each support means may include a separate roll as illustrated in FIG. 2, thereby having independent lower rolls for both the first and second support means. Any of the rolls 28, 30, 38, 40 can be a continuous roll or shaft, or a plurality of short rolls or shafts connected together. Further, any belt, chain, direct or other conventional drive relationship between the motor 44 and the belt support means 26, 28 is within the scope of this invention. In the specific embodiment illustrated in FIG. 2, the reversible motor 44 drives a pulley 50, through belt 48, which is connected to the lower roll 30 of the first belt support means 26. The lower roll 40 of the second support means is attached to pulley 52 and driven by a belt 54 connected to pulley 50.

Figure 4:
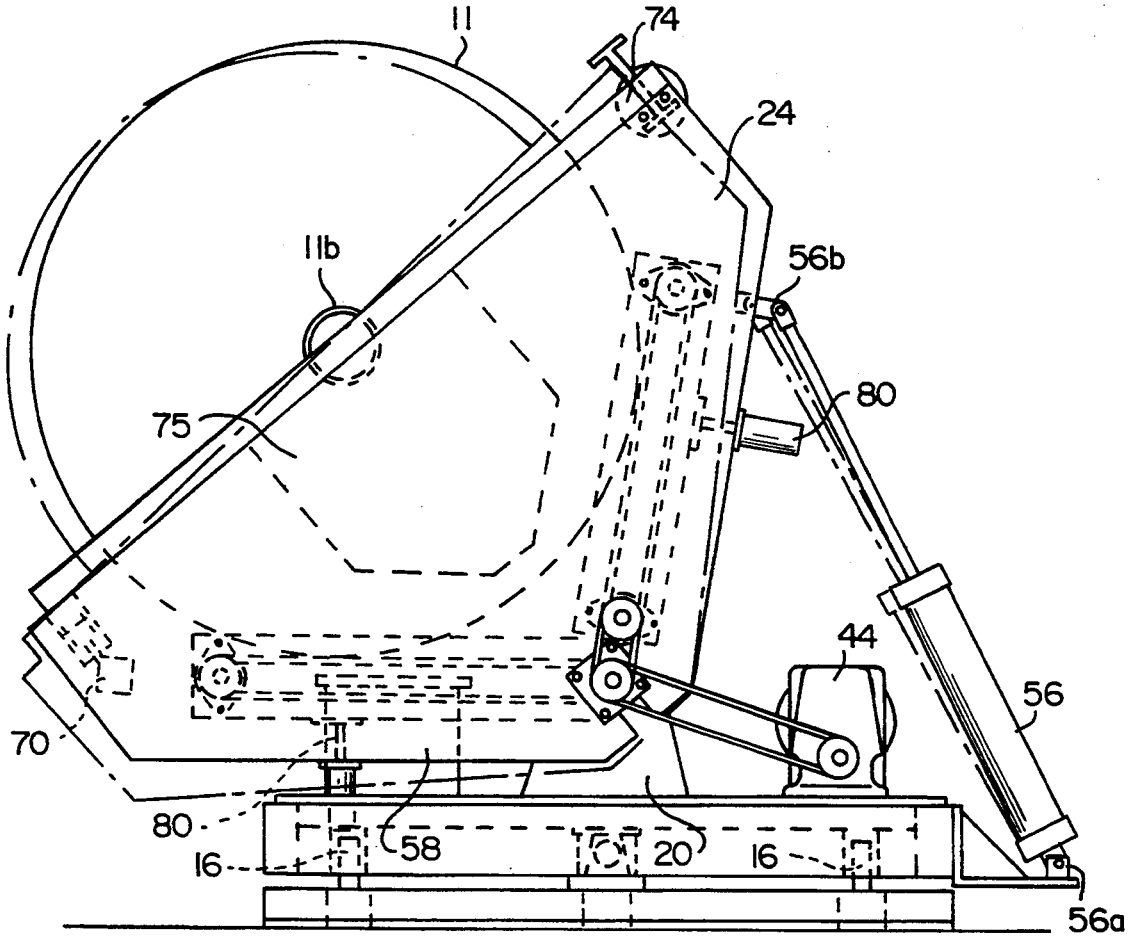
FIG. 4 is a side view of FIG. 1 with the unwind machine in the load position shown in solid lines and the unload position shown in broken lines.

The V-shaped cradle 22 is pivotal with respect to the frame 14 between a loading position as illustrated in solid lines in FIG. 4 and an unwind position as illustrated in FIG. 2. In the loading position, the cradle is pivoted to a position such that the first belt support means 26 is substantially horizontal to the frame and floor. In the unwind position, as illustrated in FIG. 2, the cradle is pivoted to a position such that both the first and second belt support means 26, 27 are angularly spaced above the horizontal.

The apparatus of the present invention includes means for controllably pivoting the V-shaped cradle relative to the frame for loading and unloading the material to be wound. As embodied herein, the means for controllably pivoting the V-shaped cradle includes at least one, and preferably a plurality, of pressure actuated cylinders 56 as illustrated in FIGS. 1, 2 and 4. As best illustrated in FIGS. 2 and 4, one end of the pressure actuated cylinders 56 is pivotally attached to the frame 14 as at 56*a* and the other end is attached to the cradle 22 such as at 56*b*. When the pressure cylinders 56 are actuated, they pivot the cradle between its unwind position as illustrated in FIG. 2 to its loading position as illustrated in FIG. 4 in solid lines, around a pivot point located at the cradle's pivotal attachment to cradle support member 20. Either the frame or support means has a manual stop as illustrated at 84 to prevent the cradle from pivoting past the horizontal when pivoted to its loading position.

The frame 14 includes means for supporting the material roll when the cradle is in the loading position. As embodied herein, the means for supporting the material roll includes a loading support member 58 attached to frame 14 and extending thereabove to a position such that when the cradle is pivoted to its loading position, the loading support member 58 will be located directly below the endless belts 32 on the first belt support means 26. As a result, the loading support member 58 supports the material roll 11 when it is placed into the cradle in the loading position because the roll will cause the belts to deform down to the support member 58. This minimizes the stress to the endless belts when the heavy roll is initially placed into the cradle.

The apparatus of the present invention can also be pivoted to an unload position as illustrated in broken lines in FIG. 4. In the unload position, the first belt support means 26 is pivoted past the horizontal to a downwardly sloping position. The reversible motor 44 can then be reversed to drive a partially empty roll out of the cradle. This alleviates the necessity for a forklift or the like to unload a partially unwound roll from the machine. Mechanical or electromechanical stops 84 are included to release the cradle past the load position and into the unload position. Further, the loading support member 58 is located sufficiently below the first belt support means 26 so as to allow the cradle to pivot to its unload position when the stops 84 are released.

The belt support means of the present invention also include means for maintaining the endless belts in alignment. As embodied herein, the means for maintaining the endless belts in alignment include crowns or ridges 60 along the rolls 28, 30, 38, and 40 as illustrated in FIG. 2. Each ridge is adapted for receipt of one of the plurality of endless belts thereover. The ridges 60 include two substantially upwardly sloped surfaces 62, 64 terminating in a raised portion 66. When the endless belts are received over the rolls 28, 30, 38, 40 at the ridged portions, the central ridge supporting each belt constantly biases each belt toward alignment with the ridge at the center of the belt. Therefore, all of the endless belts are constantly maintained in alignment without the necessity of external belt alignment guides.

Figure 3:
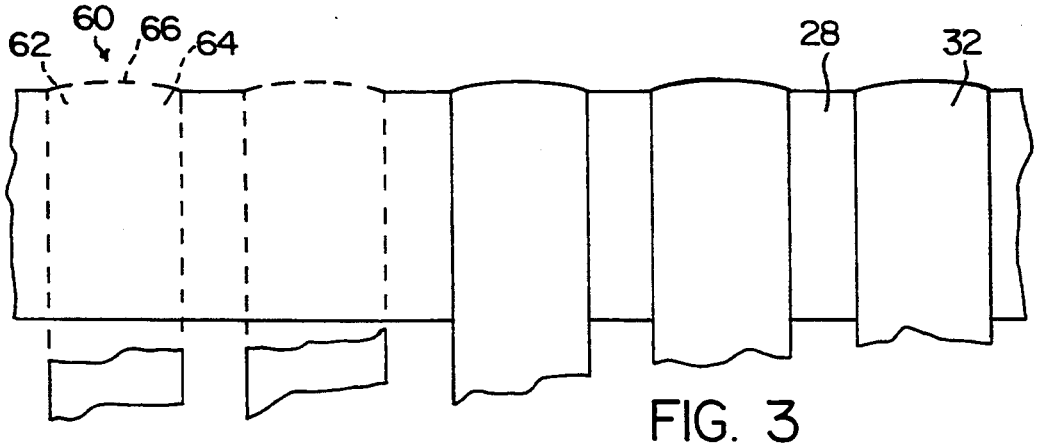
FIG. 3 is a detailed view of the endless belts of FIG. 1 in accordance with the present invention, with parts broken away.

The apparatus of the present invention also includes guide means for maintaining the roll of material in place during unwinding. As embodied herein, the guide means includes an adjustable structure which resides above the V-shaped cradle and extends down to the location where the core **11*b* of the roll is located when the roll is in the cradle. As illustrated in FIG. 2, the adjustable structure includes a first guide support member 70 located generally above the first belt support means 26 and extending laterally from end to end of the first belt support means 26. A second guide support member 72 is located generally above the second belt support means and extends laterally from end to end of the second belt support means. Guide members 74 extend across the open portion of the V-shaped cradle between the first and second guide support members 70 and 72. Guide members 74 include portions 75 that extend down into the cradle at laterally spaced locations within the cradle. Portions 75 are adapted to receive the material roll therebetween and may be in contact, but are not physically connected to the material roll or to its core when in normal operation. Portions 75 can be bars that extend toward the bottom and center 68 of the V-shaped cradle or can be wider members such as plates illustrated in FIGS. 3 and 4. The portions 75 are adapted to be laterally adjusted relative to one another so that they can be properly positioned on opposite sides of various sized material rolls and are adapted for contact with the core 11*b*** of the roll if the roll becomes misaligned during operation.

The guide members 74 can include rollers 76 adapted to move along the first guide support member 70. The guide members 74 can also include a mechanism for laterally adjusting the position of the guide members 74. Such a mechanism can include one or more threaded shafts as illustrated by 86 in FIG. 1, whereby when the cranks are turned, the guide members 74 move along above the V-shaped cradle. As further illustrated in FIG. 1, threaded rod 86 can be in two pieces, connected by a clutch mechanism 88, so that one of the guide members 74 can be adjusted independently of the other. In addition, guide members 74 can be moved along the threaded roll by cranks or motors generally illustrated at 90 in FIG. 1. Further in another embodiment, instead of the above described threaded rod arrangement, a clamping mechanism such as 78 in FIG. 2 could be utilized. In such a system, the clamps could be released so that the guide members could slide along the second guide support member for positioning relative to each other and the material roll.

In another embodiment, the apparatus can include means for absorbing shock to the belts and frame caused by out-of-round rolls of material. Preferably, the means for absorbing shock can include one or more shock absorbers 80 attached between the belt support means and the belts, or between the frame and the belt support means as illustrated in FIG. 2. If the shock absorbers are attached between the belt support means and the belts, a member 92 can be attached to the shock absorber to contact the belts when an out-of-round roll of material causes undue stress on the apparatus. In addition, the upper and lower belt support means could be mounted within a separate support frame 82 indicated in broken lines in FIG. 2, with a shock absorber attached between the separate support frame 82 and the frame 12.

In a further embodiment of the present invention, the apparatus can include means for sensing the location of the roll of material and means for adjusting the location of the frame relative to the base responsive to the location sensing means. As embodied herein, the means for sensing the location of the material roll can include sensors 94 as illustrated in FIG. 1, placed laterally along the cradle 22 for sensing the location of the roll of material. The sensors can be photoelectric or any other known type of sensors. As embodied herein, the means for adjusting the location of the frame relative to the base can include a controller 96 for receiving signals representative of the location of the material roll and supplying a signal to actuate pressure actuated cylinder 18 responsive thereto whereby the frame can be adjusted laterally relative to the base in the manner described above.

In another embodiment of the present invention, the first and second belt support means 26, 28 can be pivotal with respect to one another so that a wider variety of material roll sizes can be accommodated. The first and second support means could be pivoted and controlled in the same manner that the entire cradle is pivoted and controlled, or by any conventional means.

These and other modifications and variations to the present invention may be practiced by those of ordinary skill in the art, without departing from the spirit and scope of the present invention, which is more particularly set forth in the appended claims. Aspects of each of the embodiments may be interchanged in whole or in part. Furthermore, those of ordinary skill in the art will appreciate that the foregoing description is by way of example only, and is not intended to be limitive of the invention so further described in such appended claims.

What is claimed is:

1. An apparatus for unwinding heavy rolls of material such as fabric comprising:

a frame;

a generally V-shaped cradle pivotally attached to said frame at the apex of said cradle for supporting and driving the roll of material to be unwound, said generally V-shaped cradle comprising first and second belt support means for cradling and driving said roll, each said belt support means forming one side of the V-shaped cradle;

said V-shaped cradle being pivotal generally at its apex between a loading position where one of the belt support means of the cradle is substantially horizontal and an unwind position where both belt support means of the cradle are angularly spaced above the horizontal, and further comprising a tilting device operatively disposed for controllably pivoting the V-shaped cradle relative to the frame between said loading position and said unwind position for loading and unloading the roll of material to be unwound;

said first and second belt support means each including a plurality of endless belts, said plurality of endless belts forming the support and driving surface for the material to be unwound, said endless belts being supported on the belt support means and having a tension such that the weight of the roll displaces the belts in contact with the roll and provides an increased area of contact between the material roll and the belts;

said belt support means including means for maintaining the endless belts in alignment; and said apparatus further including means for driving said endless belts, wherein a roll of material can be received within the V-shaped cradle and can be unwound.

2. An apparatus for unwinding material from a roll as in claim 1, wherein said endless belts on both said first and second belt support means are driven in the same direction causing the surfaces of the belts in contact with the roll of material on said first support means to move in a direction toward a bottom of said V-shaped cradle direction and the surface of the belts in contact with the roll of material on said second support means to move in an opposite direction away from the bottom of said V-shaped cradle.

3. An apparatus for unwinding material from a roll as in claim 1, wherein said means for controllably pivoting the V-shaped cradle includes at least one pressure actuated cylinder attached between the V-shaped cradle and the frame.

4. An apparatus for unwinding material from a roll as in claim 1, and further including a base supporting said frame, said frame being laterally movable on said base so that the material being unwound can be aligned with a device receiving the material.

5. An apparatus for unwinding material from a roll as in claim 4, and including means for sensing the location of the material roll and means for adjusting the location of the frame relative to the base responsive to the location sensing means.

6. An apparatus for unwinding material from a roll as in claim 1, wherein each said belt support means includes a plurality of spaced apart rolls for receipt of the endless belts thereover.

7. An apparatus for unwinding material from a roll as in claim 6, wherein said means for maintaining the endless belts in alignment includes a plurality of raised central ridges on at least one of said spaced apart rolls adapted for respective receipt of the endless belts thereover so that the endless belts will remain aligned on the rolls.

8. An apparatus for unwinding material from a roll as in claim 1, and further including guide means for maintaining the material roll in place during unwinding.

9. An apparatus for unwinding material from a material roll as in claim 8, wherein said guide means is adjustable so as to accommodate material rolls of varying sizes.

10. An apparatus for unwinding material from a roll as in claim 1, wherein said first and second belt support means are pivotal with respect to each other so that the angle between the belt support means forming the V-shaped cradle can be adjusted to accommodate rolls of material of varying sizes.

11. The apparatus as in claim 1, wherein said tilting device is disposed between one side of said V-shaped cradle and said frame.

12. An apparatus for unwinding heavy rolls of material such as fabric comprising:

frame;

a generally V-shaped cradle pivotally attached to said frame for supporting and driving the roll of material to be unwound, said generally V-shaped cradle comprising first and second belt support means for cradling and driving said roll, each said belt support means forming one side of the V-shaped cradle;

said V-shaped cradle being pivotal between a loading position where one of the belt support means of the cradle is substantially horizontal and an unwind position where both belt support means of the cradle are angularly spaced above the horizontal, and further comprising means for controllably pivoting the V-shaped cradle relative to the frame for loading and unloading the roll of material to be unwound;

said first and second belt support means each including a plurality of endless belts, said plurality of endless belts forming the support and driving surface for the material to be unwound, said endless belts being supported on the belt support means such that the weight of the roll displaces the belts in contact with the roll and provides an increased area of contact between the material roll and the belts, wherein said frame includes means for supporting the material roll when the cradle is in the loading position such that said plurality of endless belts of said one of said belt support means of the cradle are deflected no more than a predetermined maximum extent, wherein said means for supporting the material roll in the loading position includes at least one support member located on said frame and oriented so that when the cradle is pivoted into the loading position, the support member is positioned near the belts and supports the material roll;

said belt support means including means for maintaining the endless belts in alignment; and said apparatus further including means for driving said endless belts, wherein a roll of material can be received within the V-shaped cradle and can be unwound.

13. An apparatus for unwinding heavy rolls of material such as fabric comprising:

a frame;

a generally V-shaped cradle pivotally attached to said frame for supporting and driving the roll of material to be unwound, said generally V-shaped cradle comprising first and second belt support means for cradling and driving said roll, each said belt support means forming one side of the V-shaped cradle;

said V-shaped cradle being pivotal between a loading position where one of the belt support means of the cradle is substantially horizontal and an unwind position where both belt support means of the cradle are angularly spaced above the horizontal, and further comprising means for controllably pivoting the V-shaped cradle relative to the frame for loading and unloading the roll of material to be unwound;

said first and second belt support means each including a plurality of endless belts, said plurality of endless belts forming the support and driving surface for the material to be unwound, said endless belts being supported on the belt support means such that the weight of the roll displaces the belts in contact with the roll and provides an increased area of contact between the material roll and the belts;

said belt support means including means for maintaining the endless belts in alignment;

a plurality of shock absorbers for absorbing shock to the belts and frame caused by out-of-round rolls of material; and said apparatus further including means for driving said endless belts, wherein a roll of material can be received within the V-shaped cradle and can be unwound.

14. An apparatus for unwinding heavy rolls of material such as fabric comprising:

a frame;

a generally V-shaped cradle pivotally attached to said frame at the apex of said cradle for supporting and driving the roll of material to be unwound, said generally V-shaped cradle comprising first and second belt support means for cradling and driving said rolls, each said belt support means forming one side of the V-shaped cradle;

said V-shaped cradle being pivotal generally at its apex between a loading position where one of the belt support means of the cradle is substantially horizontal and an unwind position where both belt support means of the cradle are angularly spaced above the horizontal, and further comprising means for controllably pivoting the V-shaped cradle relative to the frame for loading and unloading the material to be unwound, said means for controllably pivoting the V-shaped cradle including at least one pressure actuated cylinder attached between the V-shaped cradle and the frame;

said first and second belt support means each including a plurality of driven endless belts, said plurality of endless belts forming the support and driving surface for the material to be unwound, said endless belts being supported on the belt support means at a tension such that the weight of the material roll displaces the belts in contact with the material roll and provides an increased area of contact between the material roll and the belts;

said belt support means including a plurality of spaced apart rolls for receipt of the endless belts thereover, and means for maintaining the endless belts in alignment, wherein said means for maintaining the endless belts in alignment includes a plurality of raised central ridges on at least one of said spaced apart rolls adapted for respective receipt of the endless belts thereover so that the endless belts will remain aligned on the rolls; and said apparatus further including means for driving said endless belts, wherein a roll of material can be received within the V-shaped cradle and can be unwound.

15. An apparatus for unwinding material from a roll as in claim 14, wherein said endless belts are all driven in the same direction causing the surfaces of the belts in contact with the material roll on said first belt support means to move in a direction toward a bottom of said V-shaped cradle and the surface of the belts in contact with the roll of material on said second belt support means to move in an opposite direction away from the bottom of said V-shaped cradle.

16. An apparatus for unwinding material from a roll as in claim 14, and further including a base supporting said frame, said frame being laterally movable on said base so that the material being unwound can be aligned with a device for receiving the material.

17. An apparatus for unwinding material from a roll as in claim 16, and including means for sensing the location of the roll of material and means for adjusting the location of the frame relative to the base responsive to the location sensing means.

18. An apparatus for unwinding material from a roll as in claim 14, and further including guide means for maintaining the roll of material in place during unwinding.

19. An apparatus for unwinding material from a roll as in claim 18, wherein said guide means is adjustable so as to accommodate material rolls of varying sizes.

20. An apparatus for unwinding material from a roll as in claim 14, wherein said frame includes means for supporting the material roll when the cradle is in the loading position such that said plurality of endless belts of said one of the belt support means of the cradle are deflected no more than a predetermined maximum extent.

21. An apparatus for unwinding material from a roll as in claim 20, wherein said means for supporting the material roll in the loading position includes at least one support member oriented so that when the cradle is pivoted into the loading position, the support member is positioned near the belts and supports the material roll.

22. An apparatus for unwinding material from a roll as in claim 14, and further including a plurality of shock absorbers for absorbing shock to the belts and frame caused by out-of-round rolls of material.

23. An apparatus for unwinding material from a roll as in claim 14, wherein said first and second belt support means are pivotal with respect to each other so that the angle between the belt support means forming the V-shaped cradle can be adjusted to accommodate rolls of material of varying sizes.

24. An apparatus for unwinding heavy rolls of material such as fabric comprising:

a frame and a base supporting said frame, said frame being laterally movable on said base so that the roll of material being unwound can be aligned with a device receiving the material;

a generally V-shaped cradle pivotally attached to said frame at the apex of said cradle for supporting and driving the roll of material to be unwound, said generally V-shaped cradle comprising first and second belt support means for cradling and driving said rolls, each said belt support means forming one side of the V-shaped cradle;

said V-shaped cradle being pivotal generally at its apex between a loading position where one of the belt support means of the cradle is substantially horizontal and an unwind position where both belt support means of the cradle are angularly spaced above the horizontal, and further comprising means for controllably pivoting the V-shaped cradle relative to the frame for loading and unloading the roll of material to be unwound, said means for controllably pivoting the V-shaped cradle includes at least one pressure actuated cylinder attached between the V-shaped cradle and the frame, said frame including means for supporting the material roll when the cradle is in the loading position such that said plurality of endless belts of said one of the belt support means of the cradle are deflected no more than a predetermined maximum extent;

said first and second belt support means each including a plurality of endless belts, said plurality of endless belts forming the support and driving surface for the roll of material to be unwound and all being driven in the same direction causing the surface of the belts in contact with the material roll on said first and said second belt support means to move in respective directions towards and away from a bottom of said V-shaped cradle, said endless belts being supported on the belt support means at a tension such that the weight of the roll displaces the belts in contact with the roll and provides an increased area of contact between the roll and the belts;

said belt support means including a plurality of spaced apart rolls for receipt of the endless belts thereover, and means for maintaining the endless belts in alignment, said means for maintaining the endless belts in alignment including a plurality of raised central ridges on at least one of said spaced apart rolls adapted for respective receipt of the endless belts thereover so that the endless belts will remain aligned on the spaced apart rolls;

guide means for maintaining the roll of material in place during unwinding; and said apparatus further including means for driving said endless belts, wherein a roll of material can be received in the V-shaped cradle and can be unwound.

25. An apparatus for unwinding heavy rolls of material such as fabric comprising:

a frame;

a generally V-shaped cradle pivotally attached to said frame at its apex for supporting and driving the roll of material to be unwound, said generally V-shaped cradle comprising first and second belt support means for cradling and driving said roll of material, each said belt support means forming one side of the V-shaped cradle;

said V-shaped cradle being pivotal generally at its apex between a loading position where one of the belt support means of the cradle is substantially horizontal and an unwind position where both belt support means of the cradle are angularly spaced above the horizontal, and further comprising means for controllably pivoting the V-shaped cradle relative to the frame for loading and unloading the roll of material to be unwound;

said first and second belt support means each including a plurality of endless belts, said plurality of endless belts forming the support and driving surface for the roll of material to be unwound, said endless belts being supported on the belt support means such that the weight of the roll displaces the belts in contact with the roll and provides an increased area of contact between the roll of material and the belts;

said belt support means including means for maintaining the endless belts in alignment;

said apparatus including a plurality of shock absorbers for absorbing shock to said belts and said frame; and said apparatus further including means for driving said endless belts, wherein a roll of material can be received within the V-shaped cradle and can be unwound.

26. An apparatus for unwinding heavy rolls of material such as fabric and the like comprising:

a frame;

a generally V-shaped cradle pivotally attached at its apex to said frame for supporting and driving the roll of material to be unwound, said generally V-shaped cradle comprising first and second belt support means for cradling said rolls, each said belt support means forming one side of the V-shaped cradle and wherein said first and second belt support means are pivotal with respect to each other so that the angle of said V-shaped cradle can be adjusted to accommodate rolls of material of varying sizes;

said V-shaped cradle being pivotal generally at its apex between a loading position where one of the belt support means of the cradle is substantially horizontal and an unwind position where both belt support means of the cradle are angularly spaced above the horizontal, and further comprising means for controllably pivoting the V-shaped cradle relative to the frame for loading and unloading the roll of material to be unwound;

said first and second belt support means each including a plurality of endless belts, said plurality of endless belts forming the support and driving surface for the roll of material to be unwound, said endless belts being supported on the belt support means such that the weight of the roll displaces the belts in contact with the roll and provides an increased area of contact between the material roll of material and the belts;

said belt support means including means for maintaining the endless belts in alignment; and said apparatus further including means for driving said endless belts, wherein a roll of material can be received within the V-shaped cradle and can be unwound.

27. An apparatus for unwinding heavy rolls of material such as fabric and the like comprising:

a frame;

a generally V-shaped cradle pivotally attached at its apex to said frame for supporting and driving the roll of material to be unwound, said generally V-shaped cradle comprising first and second belt support means for cradling and driving said rolls, each said belt support means being separate and forming one side of the V-shaped cradle;

said V-shaped cradle being pivotal generally at its apex between a loading position where one of the belt support means of the cradle is substantially horizontal and an unwind position where both belt support means of the cradle are angularly spaced above the horizontal, and further comprising means for controllably pivoting the V-shaped cradle relative to the frame for loading and unloading the roll of material to be unwound;

said first and second belt support means each including a plurality of endless belts, said plurality of endless belts forming the support and driving surface for the roll of material to be unwound, said endless belts being supported on the belt support means such that the weight of the roll displaces the belts in contact with the roll and provides an increased area of contact between the roll of material and the belts;

said belt support means including means for maintaining the endless belts in alignment; and said apparatus further including means for driving said endless belts, wherein a roll of material can be received within the V-shaped cradle and can be unwound.

* * * * *